United States Patent [19]

Myers et al.

[11] Patent Number: 4,881,210

[45] Date of Patent: Nov. 14, 1989

[54] TORSIONALLY RIGID SUPPORT APPARATUS FOR MARINE SEISMIC TRANSDUCER

[75] Inventors: Wilbur J. Myers, Davis; Jack H. Cole, Ponca City, both of Okla.

[73] Assignee: Conoco Inc., Ponca City, Okla.

[21] Appl. No.: 155,782

[22] Filed: Feb. 16, 1988

[51] Int. Cl.[4] ..... H04R 15/00

[52] U.S. Cl. ..... 367/173; 114/244; 114/250

[58] Field of Search ..... 367/2, 4, 5, 6, 14, 367/15, 16, 17, 18, 19, 106, 129, 130, 141, 153, 155, 156, 159, 165, 166, 167, 171, 172, 173, 178, 180, 188, 910; 181/110, 112, 122, 402; 248/324, 51, 52, 49, 78; 114/244, 245, 246, 247, 249, 250, 251, 252, 253, 254, 377; 174/86, 101.5; 59/78.1, 84, 87, 93, 95

[56] References Cited

U.S. PATENT DOCUMENTS

| | | | |
|---|---|---|---|
| 2,590,530 | 3/1952 | Groenendyke | 177/352 |
| 2,780,196 | 2/1957 | Jareckie | 114/370 |
| 2,832,944 | 4/1958 | Kessler | 340/8 |
| 3,024,440 | 3/1962 | Pence | 340/4 |
| 3,027,539 | 3/1962 | Stillman, Jr. | 340/5 |
| 3,452,327 | 6/1969 | Clynch | 340/7 |
| 3,683,839 | 8/1972 | Harbisch | 114/249 |
| 3,729,162 | 4/1973 | Salvato | 367/173 |
| 3,731,264 | 5/1973 | Campbell et al. | 340/3 PS |
| 3,740,706 | 1/1973 | Joseph | 367/173 |
| 3,781,780 | 12/1973 | Dow | 340/8 S |
| 3,793,623 | 2/1974 | Gongwer | 340/8 S |

*Primary Examiner*—Brian S. Steinberger

*Attorney, Agent, or Firm*—C. R. Schupbach

[57] ABSTRACT

An apparatus for supporting a seismic transducer under water adjacent a towing vessel includes an elongated substantially rigid towing arm. A lower connector assembly is operably associated with the towing arm for connecting a lower end thereof to the transducer. An upper connector assembly is operably associated with the towing arm for connecting an upper end thereof to the vessel. The upper connector assembly includes a first pivot arrangement for permitting the lower end of the towing arm and the connected transducer to be lowered into the body of water. The upper connector assembly further includes a torsional support structure for resisting rotation of the towing arm about a longitudinal axis thereof. Preferably the upper connector assembly also includes a second pivot arrangement for permitting the lower end of the towing arm and the connected transducer to move laterally relative to the towing vessel.

18 Claims, 2 Drawing Sheets

TORSIONALLY RIGID SUPPORT APPARATUS FOR MARINE SEISMIC TRANSDUCER

BACKGROUND OF THE INVENTION

1. Field Of The Invention

This invention relates generally to improvements in marine seismic prospecting, and more particularly, but not by way of limitation, it relates to an improved relatively rigid towing arm apparatus for maintaining a seismic transducer at a predetermined depth adjacent to an operating vessel.

2. Description Of The Prior Art

In the field of marine seismic exploration, transducers of various types are typically towed adjacent an operating vessel. Various cables and conduits typically must be arranged between power and control sources on the operating vessel and the transducer being towed adjacent the operating vessel.

In earliest times, these power and control connections were typically made by way of flexible conduits running from the operating vessel to the transducer.

In more recent times, elongated stiff leg towing members have been utilized such as that disclosed in U.S. Pat. No. 3,452,357 to Clynch, and assigned to the assignee of the present invention.

In Clynch U.S. Pat. No. 3,452,327, a marine seismic source support is disclosed which maintains a seismic transducer in a rigid downward trailing attitude from the operating vessel. The Clynch apparatus includes a hollow, elongated stiff leg member which is generally wing shaped such that it can be supported from the operating vessel and allowed to cut through the water with very little resistance. The stiff leg member contains a plurality of conduits which extend the length thereof. The upper end of the stiff leg member is flexibly connected by chains or cables to a swivel block which is pivotally affixed at the vessel deck level. The swivel block receives operating power via flexible connectors between ship mounted power sources and the swivel block. A group of flexible conduits extends from the swivel block to the upper end of the stiff leg member where they are attached to ends of appropriate ones of the plural conduits of the stiff leg member. The lower end of the stiff leg member is secured again by chains or cables in a supporting fashion to the seismic transducer, while additional flexible conduits connect the respective lower ends of the stiff leg conduits to their proper input ports or fixtures about the seismic transducer.

In the Clynch apparatus, there is no rigid structural member for controlling torsional or rotational movement of the stiff leg member about its longitudinal axis.

SUMMARY OF THE INVENTION

The present invention is directed to improvements in a seismic transducer towing system generally like that of the Clynch U.S. Pat. No. 3,452,327, wherein the improvements particularly aid in providing torsional stability to the stiff leg member and thus providing superior control on the orientation of the member thereby minimizing drag on the system, minimizing rotational motion which places strain on the various flexible conduits, and minimizing variations in depth of the towed transducer from the surface of the water.

The apparatus of the present invention generally provides a means for supporting a marine seismic transducer under water adjacent a towing vessel. It includes an elongated substantially rigid support member or towing arm having a lower connector means operably associated therewith for connecting a lower end of the support member to the transducer. It further includes an upper connector means operably associated with the support member for connecting an upper end of the support member to the towing vessel. This upper connector means includes a first pivot means for permitting the lower end of the support member to be lowered into the body of water, and includes a torsional support means for resisting rotation of the support member about a longitudinal axis thereof.

The upper connector means preferably also includes a second pivot means for permitting the lower end of the support member and the attached transducer to move laterally relative to the towing vessel.

The torsional support means is particularly useful with rigid support members having a cross-sectional shape such that the support member is not dynamically rotationally stable when towed through the water at the desired speeds.

Numerous objects, features and advantages of the present invention will be readily apparent to those skilled in the art upon a reading of the following disclosure when taken in conjunction with the accompanying drawings.

DESCRIPTION OF THE PREFERRED EMBODIMENTS

Figures 1, 2:
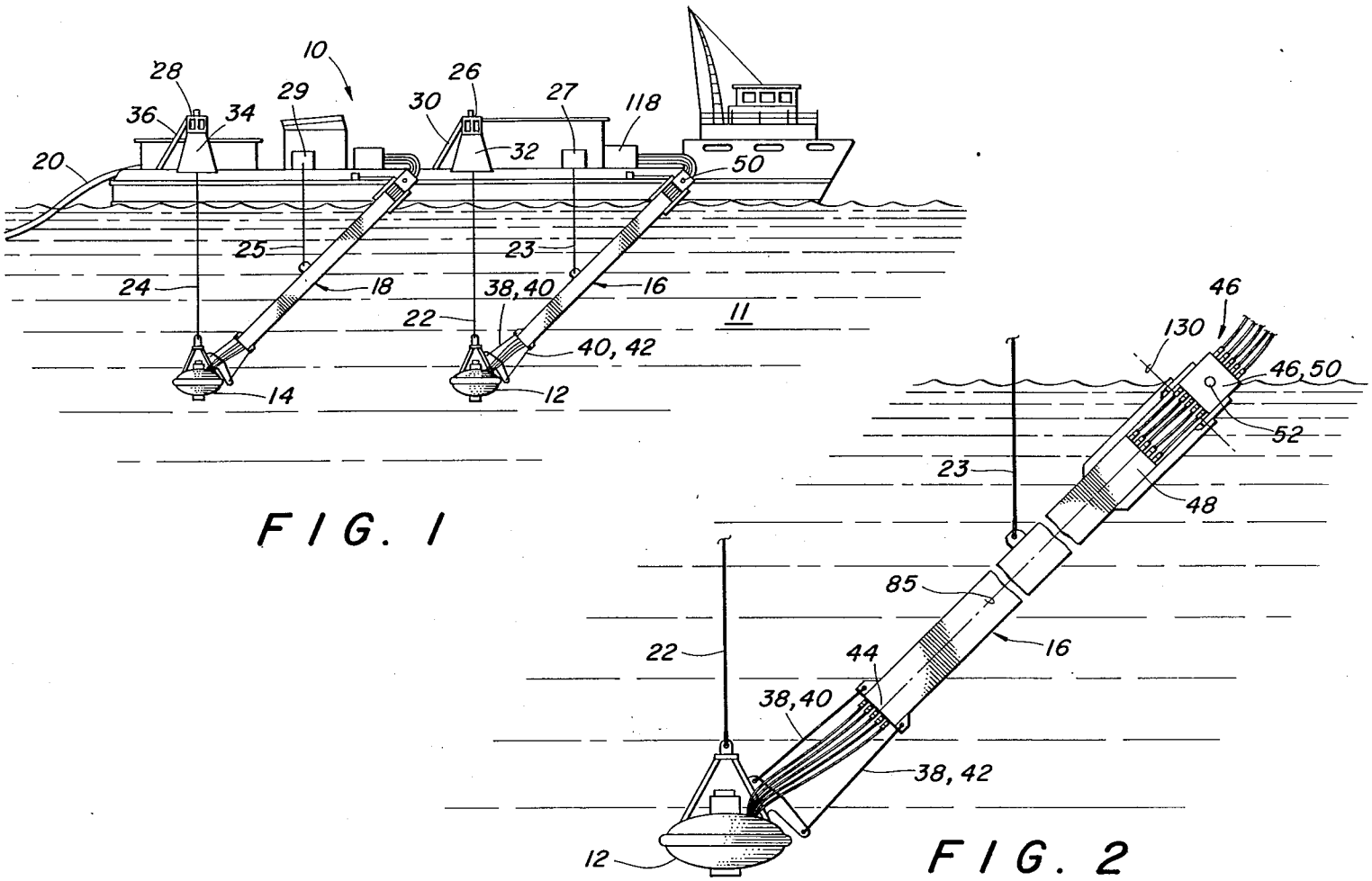
FIG. 1 is a side view of a sesmic exploration operating vessel utilizing the rigid towing arms and associated apparatus of the present invention.
FIG. 2 is an enlarged elevation view of one of the rigid towing arms showing the associated connective rigging as it would be attached to a seismic transducer in operating attitude.

FIG. 1 shows a side view of a seismic exploration vessel 10 in its operating attitude. Such a rig as vessel 10 is known in the art as a one-ship rig in that it carries both the seismic energy generation equipment as well as the returned seismic energy detection equipment and all of the control and power apparatus attendant to the equipment. Thus, the vessel 10 is shown with a pair of seismic transducers 12 and 14 supportingly connected to elongated substantially rigid towing arms or support members 16 and 18 which are supported fore and aft, respectively, on the starboard side of the vessel 10.

The transducers 12 and 14 can generally be referred to as articles 12 and 14 which are towed by the towing arms 16 and 18, respectively.

Actually, in its preferred form, the vessel 10 carries four seismic transducers, two additional transducers (not shown) being similarly positioned on the port side of vessel 10. The detection of returned seismic energy is effected by means of a conventional type of multi-geophone streamer 20 which is trailed at a distance off the stern of vessel 10 during a sounding sequence.

The seismic transducers 12 and 14 are supported by respective cables 22 and 24 which are connected to weighing apparatus 26 and 28. Weighing apparatus 26 is directed outboard over the starboard side of vessel 10 by means of a support platform 30 which supports a latch-up basket 32 out over the water.

A suitable winch or other deck machinery (not shown) can then be employed to draw cable 22 up through latch-up basket 32 so that the seismic transducer 12 can be locked up within the latch-up basket 32 during movement between shooting sites, rough seas, etc.

A second supporting cable 23 is connected at an intermediate point of the towing arm 16 and is drawn up by a winch 27 to aid in the weighing operation.

Seismic transducer 14 may be similarly weighed and housed by means of cable 24 and latch-up basket 34 as supported by support platform 36. Again, a second cable 25 is connected to an intermediate point of second towing arm 18 and is drawn up by a winch 29 to aid in the weighing operation.

Referring now to FIG. 2, the forwardmost towing arm 16 is thereshown in enlarged view.

The towing arm 16 is an elongated substantially rigid towing arm. A lower connector means 38, generally comprised of a pair of connector towing cables 40 and 42, is connected between a lower end 44 of towing arm 16 and the transducer 12.

An upper connector means 46 connects an upper end 48 of towing arm 16 to the vessel 10.

Figure 3:
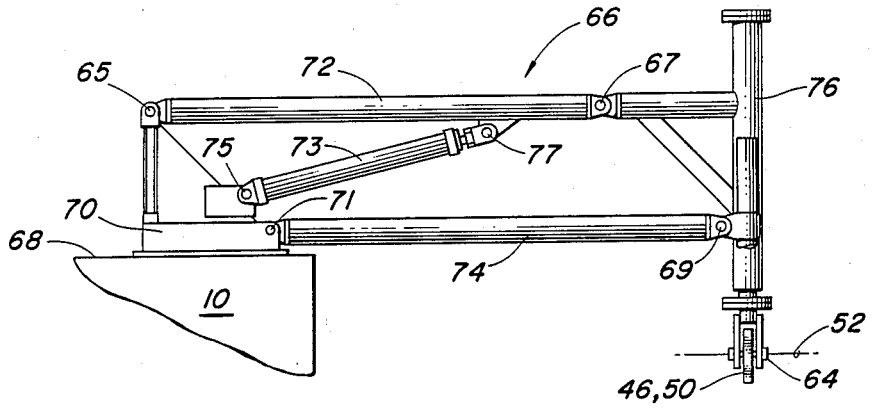
FIG. 3 is an elevation view of a portion of the deck of the operating vessel to show the manner in which the rigid towing arm and associated apparatus are supported outboard of the towing vessel.
Figure 4:
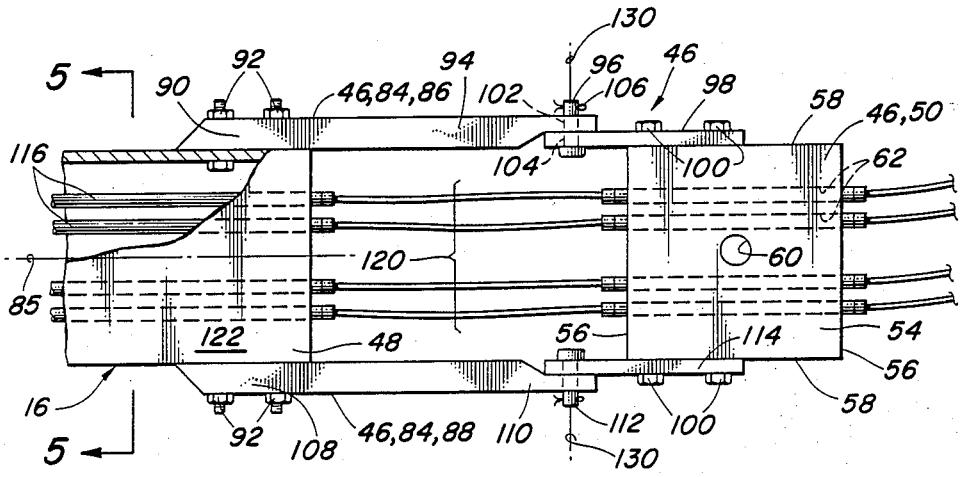
FIG. 4 is a further enlarged elevation view of the upper end of the rigid towing arm, and the various associated apparatus connecting the upper end of the rigid towing arm to the towing vessel.

The upper connector means 46 is best seen in the enlarged view of FIG. 4. Upper connector means 46 includes a swivel member 50 (which may also be referred to as a manifold block 50) which is secured to the vessel 10 and is pivotable about a generally horizontal first axis 52 (see FIG. 3). The first axis 52 may be described as being transverse to a length of the vessel 10 or athwartships of the vessel 10.

The swivel member 50, as seen in FIG. 4, is a metal block which can be described as a rectangular parallelepiped manifold block having first, second and third mutually perpendicular pairs of opposite parallel outer surfaces 54, 56, and 58, respectively.

In one embodiment, swivel member 50 has a swivel bore 60 extending therethrough intersecting said first pair of outer surfaces 54 and defining said first axis 52 perpendicular to the first pair of outer surfaces 54.

Further, the swivel member 50 has a plurality of fluid conducting manifold passages, such as somewhat schematically illustrated by the numeral 62 in FIG. 4. These fluid conducting manifold passages 62 are disposed through the swivel member 50 and intersect the second pair of outer surfaces 56 thereof.

Turning now to FIG. 3, the manner of support of the swivel member 50 from the vessel 10 is there illustrated.

The swivel member 50 has its bore 60 rotatably disposed about an axle member 64.

The horizontal axle member 64 is attached to a parallelogram-type lifting arm assembly 66 supported from the deck 68 of the vessel 10.

The lifting arm assembly 66 is shown in FIG. 3 in its outboard position which it maintains when the towing arm 16 is in an operating position as illustrated in FIG. 1.

When the transducer 12 is drawn up into the latch-up basket 32 as previously described for transport, it is desirable to swing the forward end of the towing arm 16 inboard so it can also be secured in place during transport. It is desirable when moving the forward end of towing arm 16 to an inboard position, however, to maintain the axle 64 and axis 52 in a substantially horizontal position so that the structure of the towing arm 16 will not be twisted.

This is accomplished by the parallelogram-type lifting arm assembly 66. The lifting arm assembly 66 has a base 70 located upon the deck 68. The four sides of the parallelogram-type linkage are defined by the base 70, which is seen to have a substantial vertical dimension, upper and lower horizontal bars 72 and 74, respectively, and an outer support structure 76, with four pivotal connections therebetween as indicated at 65, 67, 69 and 71.

The motion of the parallelogram-type lifting arm assembly 66 is controlled by a hydraulic ram 73 which is pinned at 75 and 77 to the base 70 and upper arm 72, respectively.

To move the forward portion of the towing arm 16 from the outboard position represented in FIG. 3, to an inboard position closely adjacent the vessel 10, the hydraulic ram 73 is extended thus swinging the upper and lower arms 72 and 74 through a counterclockwise rotation about pivots 65 and 71, respectively, as viewed in FIG. 3. This swings the outer section 76 with the attached swivel member 50 inward toward the vessel 10 while maintaining the axis 52 of rotation of swivel member 50 in a substantially horizontal position.

Returning to the details of the upper connector means 46 in FIGS. 2 and 4, the upper connector means 46 includes, in addition to the swivel member 50, a torsional support means 84 for resisting rotation of the towing arm or elongated support member 16 about a longitudinal axis 85 thereof. The torsional support means 84 includes a pair of spaced substantially parallel rigid support arms 86 and 88. The support arm 84 is fixedly connected at a first end 90 thereof to the upper end 48 of the towing arm 16 by a plurality of bolt connectors 92. Rigid support arm 86 is pivotally connected at its second end 94 to the swivel member 50 by pivot pin 96.

The swivel member 50 has a pivot plate 98 fixedly attached thereto by threaded bolts 100.

Aligned bores 102 and 104 of support arm 86 and pivot plate 98 receive the pivot pin 96 therein. The pivot pin 96 is held in place by retaining pin 106.

Similarly, the other rigid support arm 88 has one end 108 thereof fixedly connected to the upper end 48 of towing arm 16 by bolts 92 and has another end 110 thereof pivotally connected to swivel member 50 by a pivot pin 112 associated with a second pivot plate 114. The second pivot plate 114 is rigidly attached to swivel member 50 by threaded bolts 100.

Figure 5:
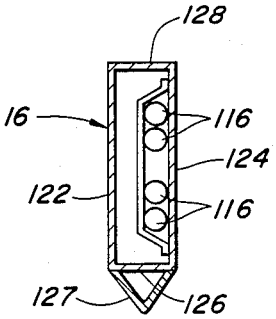
FIG. 5 is a cross-section view taken along line 5—5 of FIG. 4 somewhat schematically illustrating the internal construction of the rigid towing arm.

As seen in FIGS. 4 and 5, the elongated towing arm 16 is a hollow member having a plurality of rigid conduit means 116 disposed therein for connecting a power source 118 on the vessel 10 to the transducer 12.

A plurality of flexible hoses 120 is connected between the swivel member or manifold block 50 and the rigid conduits 116.

As best seen in FIG. 5, the towing arm or elongated support member 16 is substantially rectangular in cross section having a pair of longer cross-sectional sides 122 and 124 and a pair of shorter cross-sectional sides 126 and 128. It may also have a fairing 127 added to its forward edge to reduce drag.

The preferred orientation of the rectangular cross section towing arm 16, in order to minimize the drag forces on the towing arm 16 as it is pulled through the water, is one in which the longer cross-sectional sides 122 and 124 are oriented in generally vertical planes as seen in FIGS. 4 and 5.

The torsional support means 84 including the rigid support arms 86 and 88 is adequate to eliminate any substantial rotation of towing arm 16 about its longitudinal axis 85 relative to swivel member 50, thus holding the towing arm 16 in an attitude as illustrated in FIG. 5 with its longer cross-sectional sides 122 and 124 oriented in generally vertical planes.

It will be appreciated that towing arms of other cross-sectional shapes, such as the faired wing shape of FIG. 4 of U.S. Pat. No. 3,452,327 to Clynch may also be utilized with the present invention.

The torsional support means 84 can be generally described as also being a means for pivotally connecting the upper end 48 of towing arm 16 to the swivel member 50, said torsional support means 84 being pivotal relative to the swivel member 50 about a second axis 130 defined through swivel pins 96 and 112 (see FIG. 4). This second axis 130 is transverse to, and in fact is preferably perpendicular to, the longitudinal axis 85 of the elongated towing arm 16.

Furthermore, it is noted that the axis 130 defined by pivot pins 96 and 112 is preferably substantially perpendicular to the generally horizonal axis 52 about which the swivel member 50 rotates relative to the axle 64.

It is further noted that the axis 130 defined between pivot pins 96 and 112 is oriented generally parallel to both the first and second pairs 54 and 56, respectively, of outer surfaces of swivel member 50.

Further, the first generally horizontal axis 52 about which swivel member 50 rotates, and the second axis 130 defined between pivot pins 96 and 112, can generally be described as two non-parallel axes about which the towing arm 16 may pivot relative to the vessel 10. As previously noted, these two non-parallel axes 52 and 130 are preferably substantially perpendicular to each other.

The pivotal movement of towing arm 16 about the first generally horizonal axis 52 is for the purpose of permitting the lower end 44 of towing arm 16 and the seismic transducer 12 connected thereto to be lowered into a body of water such as the body of water indicated by numeral 11 in FIG. 1.

The pivotal movement of towing arm 16 relative to vessel 10 about the second axis 130 is for the purpose of permitting lateral movement of the transducer 12 relative to the vessel 10.

The swivel member 50 and its associated structural relationship to the axle 64 can generally be referred to as a first pivot means of the upper connector means 46 for permitting the lower end 44 of towing arm 16 to be lowered into the body of water 11. Similarly, the pivot pins 96 and 112 and their associated interrelationship with the rigid support arms 86 and 88, and the swivel plates 98 and 114 can generally be referred to as a second pivot means of the upper connector means 46 for permitting the lower end 44 of towing arm 16 to move laterally relative to the vessel 10.

Operation

Seismic exploration employing a one-ship rig utilizing a plurality of elongated relatively rigid towing arms such as 16 and 18 is generally conducted as follows.

The respective seismic transducers 12 and 14 (and a similar pair on the port side of vessel 10) can be lowered from their respective latch-up baskets such as 32 and 34 by cables such as 22, 23, 24 and 25. The towing arms 16 and 18 will automatically guide the transducers such as 12 and 14 to their proper seismic energy generation depth.

The particular significance of the improvements of the present invention, as compared to prior apparatus like that of Clynch U.S. Pat. No. 3,452,327, is in the added stability and control provided for the positioning of the towing arm 16 and attached transducer 12, particularly when the vessel is moving at relatively high speeds.

With apparatus like that of Clynch U.S. Pat. No. 3,452,327 wherein the rigid towing arms are not restrained from rotational motion about their longitudinal axes, hydrodynamic forces acting upon the elongated towing arms may cause them to rotate from a position like that shown in the Clynch patent. For example, the towing arm could rotate through an angle of approximately 90° so that its wider cross-sectional dimension was oriented substantially perpendicular to the direction of travel, thus greatly increasing drag forces on the system, and causing upward fluid forces on the towing arm.

Such rotational movement, in addition to increasing the drag on the system, provides a twisting strain upon the various flexible hydraulic hoses, and causes variations in the depth of the transducer from the surface of the water.

Such adverse rotational motion is more particularly a problem where the towing arm has a substantially rectangular cross-sectional shape as shown in FIG. 5.

The present invention, wherein a torsional support means is provided greatly eliminates these problems. The torsional support means prevents any substantial rotation of the towing arm 16 about its longitudinal axis 85 thus preventing twisting of the flexible hoses such as 120, and preventing the other adverse effects such as increased drag and variations in transducer depth. The torsional support means 84 of the present invention may be described as imparting a dynamic rotational stability to the towing arm 16.

At the same time, however, a sufficient degree of freedom of movement of the transducer 12 is permitted by the pivotal movement of towing arm 16 about the first and second pivotal axes 52 and 130 previously described.

Thus it is seen that the apparatus of the present invention readily achieves the ends and advantages mentioned as well as those inherent therein. While certain preferred embodiments of the present invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. Apparatus for supporting a marine seismic transducer from a vessel, comprising:

an elongated substantially rigid towing arm;

a connector means for connecting said transducer to a lower end of said towing arm;

a swivel member which is secured to said vessel and is pivotable about a generally horizontal first axis transverse to a length of said vessel; and a support means for pivotally connecting an upper end of said towing arm to said swivel member, said support means being pivotal relative to said swivel member about a second axis transverse to a longitudinal axis of said towing arm, said support means being substantially rigid so as to prevent any substantial rotation of said towing arm about its said longitudinal axis.

2. The apparatus of claim 1, wherein:

said swivel member and said support means are further characterized in that said first and second axes are substantially perpendicular to each other.

3. The apparatus of claim 1, wherein:

said support means is further characterized in that said second axis is substantially perpendicular to said longitudinal axis of said towing arm.

4. The apparatus of claim 1, wherein:

said support means includes a pair of spaced substantially parallel rigid support arms, each fixedly connected at a first end thereof to said towing arm and each pivotally connected at a second end thereof to said swivel member.

5. The apparatus of claim 1, wherein:

said swivel member is a rectangular parallelepiped manifold block having first, second and third mutually perpendicular pairs of opposite parallel outer surfaces;

said swivel member has a swivel bore extending therethrough intersecting said first pair of outer surfaces and defining said first axis perpendicular to said first pair of outer surfaces;

said swivel member has a plurality of fluid conducting manifold passages disposed therethrough intersecting said second pair of outer surfaces; and said second axis of pivotal connection between said support means and said swivel member is parallel to both said first and second pairs of outer surfaces.

6. The apparatus of claim 1, wherein:

said towing arm is substantially rectangular in cross section having a pair of longer cross-sectional sides and a pair of shorter cross-sectional sides; and said support means is further characterized in that when said transducer has been lowered into a towing position said pair of longer cross-sectional sides are oriented in generally vertical planes.

7. An apparatus for supporting a marine seismic transducer from a vessel, comprising:

an elongated substantially rigid support member;

lower connector means, operably associated with said support member, for connecting a lower end of said support member to said transducer; and upper connector means, operably associated with said support member, for connecting an upper end of said support member to said vessel, and for permitting said support member to pivot relative to said vessel about each of two seperate, but non-parallel axes while preventing any substantial rotation of said support member about a longitudinal axis thereof.

8. The apparatus of claim 7, wherein:

said upper connector means is further characterized in that said two non-parallel axes are substantially perpendicular to each other.

9. The apparatus of claim 7, wherein:

said upper connector means is further characterized in that one of said two non-parallel axes is a generally horizontal athwartships axis, thus permitting said transducer to be lowered into a body of water.

10. The apparatus of claim 9, wherein:

said upper connector means is further characterized in that the other of said two non-parallel axes is oriented so as to permit lateral movement of said transducer relative to said vessel.

11. The apparatus of claim 7, wherein:

said support member is substantially rectangular in cross section having a pair of longer cross-sectional sides and a pair of shorter cross-sectional sides; and said upper connector means is further characterized in that when said transducer has been lowered into a towing position said pair of longer cross-sectional sides are oriented in generally vertical planes.

12. An apparatus for supporting an article under water adjacent a towing vessel, comprising:

an elongated substantially rigid support member;

a lower connector means, operably associated with said support member, for connecting a lower end of said support member to said article; and an upper connector means, operably associated with said support member, for connecting an upper end of said support member to said vessel, said upper connector means including:

a first pivot means for permitting said lower end of said support member to be lowered into a body of water; and torsional support means for resisting rotation of said support member about a longitudinal axis thereof.

13. The apparatus of claim 12, wherein said upper connector means further comprises:

a second pivot means for permitting said lower end of said support member to move laterally relative to said vessel.

14. The apparatus of claim 13, wherein:

said upper connector means is further characterized in that said first and second pivot means allow pivotal movement about first and second substantially perpendicular axes, respectively.

15. The apparatus of claim 12, wherein:

said torsional support means includes a pair of spaced substantially parallel rigid support arms, each fixed at a first end thereof to said upper end of said support member, and each connected at a second end thereof to said first pivot means.

16. The apparatus of claim 15, wherein:

said torsional support means is further characterized in that said second ends of said rigid support arms are pivotally connected to said first pivot means so that said lower end of said support member is permitted to move laterally relative to said vessel.

17. The apparatus of claim 12, wherein:

said first pivot means is a manifold block secured to said vessel and pivotable about a generally horizontal axis transverse to a length of said vessel;

said elongated support member is a hollow member having a plurality of conduit means disposed therein for connecting a power source on said vessel to said article;

said apparatus further includes a plurality of flexible hoses connected between said manifold block and said conduits; and said torsional support means is further characterized as a means for preventing twisting of said plurality of flexible hoses.

18. The apparatus of claim 12, wherein:

said support member is substantially rectangular in cross section having a pair of longer cross-sectional sides and a pair of shorter cross-sectional sides; and said torsional support means is further characterized in that when said article has been lowered into a towing position said pair of longer cross-sectional sides are oriented in generally vertical planes.

* * * * *